United States Patent [19]

Laurent et al.

[11] 4,442,988

[45] Apr. 17, 1984

[54] INFORMATION TRANSMISSION DEVICE THROUGH THE RAILS BETWEEN A RAILWAY TRACK AND A VEHICLE ASSEMBLY CIRCULATING ON THIS TRACK

[75] Inventors: Daniel M. Laurent, Paris; Claude Thézé, Montigny les Cormeilles, both of France

[73] Assignee: Jeumont-Schneider Corporation, Puteaux, France

[21] Appl. No.: 322,016

[22] PCT Filed: Mar. 24, 1981

[86] PCT No.: PCT/FR81/00042

§ 371 Date: Nov. 16, 1981

§ 102(e) Date: Nov. 16, 1981

[87] PCT Pub. No.: WO81/02714

PCT Pub. Date: Oct. 1, 1981

[30] Foreign Application Priority Data

Mar. 25, 1980 [FR] France ..... 80 06570

[51] Int. Cl.[3] ..... B61L 21/00; B61L 3/00

[52] U.S. Cl. ..... 246/34 CT; 246/34 R; 246/121; 246/167 R

[58] Field of Search ..... 246/28 R, 121, 63 R, 246/63 A, 63 C, 34 R, 34 CT, 167 R, 37

[56] References Cited

U.S. PATENT DOCUMENTS

| | | | |
|---|---|---|---|
| 4,026,505 | 5/1977 | Geiger et al. | 246/34 R |
| 4,074,879 | 2/1978 | Clark et al. | 246/34 CT |

FOREIGN PATENT DOCUMENTS

| | | |
|---|---|---|
| 7271 | 1/1980 | European Pat. Off. . |
| 1455427 | 5/1979 | Fed. Rep. of Germany . |
| 1451431 | 10/1976 | United Kingdom . |

*Primary Examiner*—James J. Groody

*Attorney, Agent, or Firm*—Rines and Rines, Shapiro and Shapiro

[57] ABSTRACT

An improvement in apparatus for the secure transmission of information through rails in zones of propagation independent from the sections of the track block-section system embodying the use of series resonant circuits tuned to the information carrier frequency and connected between the rails at the end of a transmission zone and comprising two identical series resonant circuits disposed in parallel and each comprising a capacitor in series with the primary winding of a transformer, with the secondary windings of the two transformers being connected in series and in opposition, so that an oscillating signal appears at the terminals of the circuit thus formed in the case of failure of one of the resonant circuits.

7 Claims, 2 Drawing Figures

Figure 1:
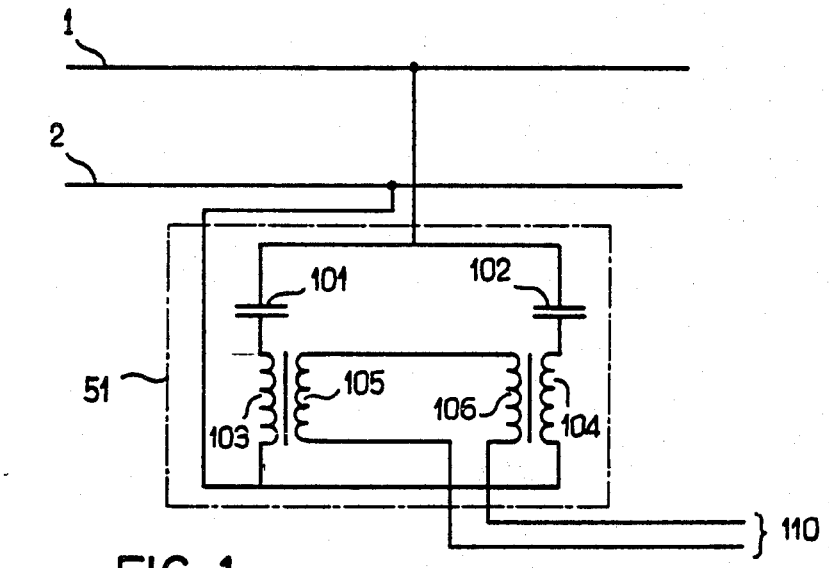

INFORMATION TRANSMISSION DEVICE THROUGH THE RAILS BETWEEN A RAILWAY TRACK AND A VEHICLE ASSEMBLY CIRCULATING ON THIS TRACK

The present invention relates to apparatus for transmission of information through the rails between a railway track and a set of vehicles circulating in the same direction on that track, along which there are a number of successive zones of information transmission.

More specifically, the present invention concerns an improvement brought about in such a device which has been described notably in the European patent application publication No. 0007 271 and PCT publication No. WO81/02714, October, 1981.

As is known, such a device comprises:

1. On the track, for each information transmission zone:

a signal generator oscillating at a determined frequency which constitutes the carrier frequency of the information to be transmitted, this frequency to be selected outside the band of frequencies utilized in the block-section system;

a modulator of the said signals;

a unit for control of the modulator in such a way that the signals will be modulated as a function of the information to be transmitted;

an insulated winding of a conductor placed in the form of a loop between the two rails of the track, near the downstream end of the said information transmission zone;

an impedance-adapting and circuit-separation transformer whose primary receives the modulated signals, and whose secondary is connected to the terminals of the loop winding;

two resonant circuits tuned to the carrier frequency, connected between the two rails of the track, one at the downstream end and the other at the upstream end of the information transmission zone.

2. On board each vehicle:

reception mechanisms, tuned to the respective carrier frequencies of the information transmission zones.

With a view to ensuring the intrinsic security of the device, in the railroading sense of the term, it is necessary to limit greatly the crosstalk within a given zone. Thus, the user must know at any instant if the resonant circuits forming each information transmission zone may be open, or may present a resonant frequency different from that emitted by the signal generator, because from augmentation of the impedance of one of these resonant circuits there would result an inopportune propagation of the signals emitted in one zone to an adjacent zone, and thus a crosstalk which could be substantial.

To this end, an object of the present invention is to provide a new and improved information transmission device and apparatus, particularly useful in railroading and similar applications and constructed to obviate the above and other difficulties and disadvantages.

Other and further objects are hereinafter presented and are more fully delineated in the appended claims.

In summary, according to the present invention, a series resonant circuit tuned to the carrier frequency connected between the two rails of the track at each of the ends of a transmission zone is formed of two identical series resonant circuits arranged in parallel, and each comprising a capacitor in series with the primary winding of a transformer, the secondary windings of the two transformers being connected in series and in opposition, in such a way that a signal oscillating at the carrier frequency appears at the terminals of the circuit thus formed when the two series resonant circuits present differing characteristics.

According to a second mode of realization of the invention, the circuits constituted by the secondary windings connected in series and in opposition of the two transformers of each of the two resonant circuits, tuned to two different frequencies, and connected respectively at the downstream end of one, and the upstream end of the immediately adjacent zone, are connected in series through the intermediary of the secondary winding of a fifth transformer, to the terminals of the primary winding of which is applied an oscillating signal, so that in case of modification of the characteristics of one of the resonant circuits, the frequency of the alternating signal appearing at the terminals of the circuit thus formed enables determination of the failed resonant circuit. With a view to detect in addition a simultaneous failure of the two series resonant circuits arranged in parallel and having the same resonant frequency, each of these circuits is connected to the rails of the track by an electrical cable of its own, so that the cables connected to one of the rails and the loop winding are coupled. The transformers each include a second secondary winding, with the second secondary windings of the transformers included in series resonant circuits having the same resonant frequency being connected in series and addition, so that an oscillating signal respresentative of the signals circulating in the rails of the track may be formed.

Figure 2:
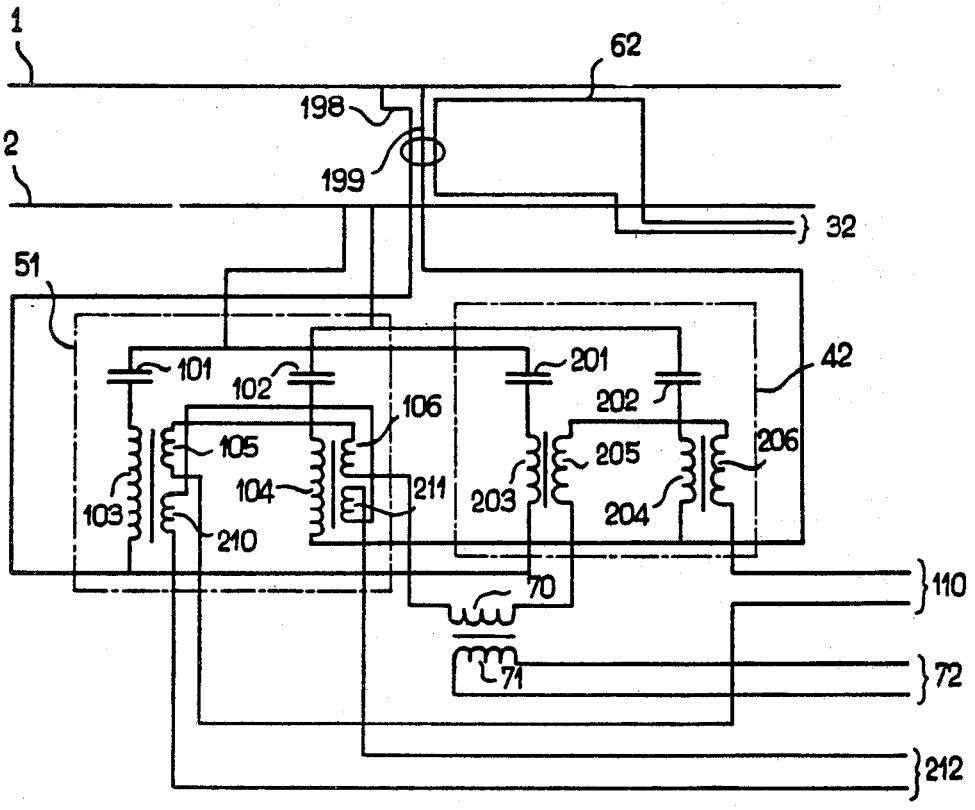

The invention will be better understood, and other goals, advantages and characteristics will become more clear through the reading of the following description of best or preferred modes of realization, described in connection with the appended drawings, in which, FIG. 1 represents schematically the circuit constituting the series resonant circuit connected between the rails of the track at one end of an information transmission zone; and FIG. 2 represents schematically the circuit constituting the series resonant circuits connected respectively at the downstream end of one zone and the upstream end of the immediately adjacent zone, and the associated control circuits.

Referring to FIG. 1, the circuit 51 constitutes the series resonant circuit connected between the two rails 1 and 2 of the track (at one end of an information transmission zone conforming to the above-cited patent).

The circuit 51 must present essentially zero impedance for the alternating information carrier frequency of the zone it terminates. The circuit 51 is constituted by two series resonant circuits connected in parallel, and each comprising a capacitor 101 and 102 and the primary windings 103 and 104 of a transformer shown there-below.

The secondary windings 105 and 106 of the two transformers are connected in series and opposition, and the circuit thus formed is connected (at its terminals 110) to a control circuit (not represented).

Thus, an oscillating signal whose frequency is equal to the carrier frequency appears at the terminals 110 if the characteristics of one of the series resonant circuits undergoes a modification, and, in particular, if one of the two circuits is broken, or if any component causes the resonance frequency of one of the two circuits to drift.

Referring to FIG. 2, the circuit 42 corresponds to a series resonant circuit connected upstream of one zone, and the circuit 51 corresponds to a resonant circuit connected downstream of the immediately adjacent zone. The carrier frequencies of the two zones being different, the resonance frequencies of the circuits 42 and 51 are different. This offers the advantage of being able to evaluate the crosstalk, or, more specifically, the ratio of the useable current to the current arising from the adjacent zone.

In the same manner as above, the secondary windings 105 and 106, and 205 and 206, respectively, are connected in series and opposition.

They are in addition connected together through the intermediary of the secondary winding 70 of a transformer, to the primary winding 71 of which an oscillating signal is applied through the terminals 72. If no anomaly is determined, the signal received at the terminals 110 is an alternating signal of the same frequency as that of the signal applied at the terminals 72. On the other hand, if the resonance frequency of any of the resonant circuits constituted by the capacitors 101, 102, 201, 202 in series respectively with the primary windings 103, 104, 203, 204 is altered, the frequency received will be different from that of the signal applied, and will be representative of the failing resonant circuit.

For example, if to the terminals 72 a signal of frequency f is applied, with F1 and F2 being the carrier frequencies of the two adjacent zones, the signal received at output terminals 110 is the sum of a signal of frequency f and a signal of frequency F1 in the case of failure of the resonant circuit of the circuit 42, or the sum of the signal of frequency f and a signal of frequency F2 in the case of failure of the resonant circuit of the circuit 51.

However, as can be seen in FIG. 1, if one of the cables linking the circuit 51 to the rails 1 and 2 of the track is broken, no signal will appear at the terminals 110, and the control center, not represented, cannot detect this failure, whose consequences could be extremely troublesome.

To remedy this, as represented in FIG. 2, each of the resonant circuits of the circuits 51 and 42 is connected to the rails of the track by a different cable. In particular, the cables 198 and 199 are connected to the loop winding 62, and connected to the information carrier signal generator 32. The transformers for example of the circuit 51 each include a second secondary winding 210 and 211.

These two secondary windings 210 and 211 are connected in series and addition, and to the control center, not represented, through the terminals 212. Thus with the information carrier signals being emitted continuously, there appears at the terminals 212 a signal corresponding to the sum of the signals circulating in the primary windings 103 and 104 of these two transformers.

This signal received at the terminals 212 enables monitoring of the carrier signal emitted in the loop 62 and the good condition of the cables connecting the circuits 51 and 42 to the rails of the track. The connection of the cables 198 and 199 with the loop 62 is necessary to maintain a correct signal at the terminals 212 when a train, passing across a branch in the rails, short-circuits it.

Although only certain modes or realization have been described, it is obvious that any modification brought about within the same spirit by one skilled in the art will not constitute a departure from the scope of the present invention.

We claim:

1. Apparatus for transmission of information through the rails between a railway track and a set of vehicles circulating in the same direction on that track in a manner independent of the railway block-section system and of the track circuit type, along which track there are, in succession, a number of information transmission zones, delimited upstream and downstream by resonant circuit means tuned to the carrier frequency of signals emitted by means of a conductive loop placed between the two rails of the track, near the downstream end of each zone, coupling these signals to the rails of the track by induction, said apparatus characterized by an improved resonant circuit means tuned to the carrier frequency and connected between the rails of the track at each end of an information transmission zone, said resonant circuit means comprising two identical series resonant circuits disposed in parallel and tuned to the carrier frequency, and each having a capacitor connected in series with the primary winding of a transformer, the secondary windings of the two transformers being connected in series and opposition between output terminals, so that an alternating signal representative of the failure of one of the said two series resonant circuits appears at said output terminals.

2. Apparatus according to claim 1, wherein the loops of successive information transmission zones emit different carrier frequencies and wherein the resonant circuits connected respectively downstream of one information transmission zone and upstream of the immediately adjacent zone are tuned to said different carrier frequencies, respectively, and have their secondary windings connected in series between said output terminals through the intermediary of the secondary winding of a further transformer having a primary winding to which is applied an alternating signal, such that an alternating signal representative of the failure of one of the last-mentioned resonant circuits appears at said output terminals and enables determination of said one last-mentioned circuit.

3. Apparatus according to claim 1, wherein each of the said resonant circuits is connected to the rails of the track by its own electrical cable coupled to the loop of the respective zone and the said two transformers are provided with second secondary windings connected between additional output terminals in series and addition, so that a signal representative of the signals circulating in the rails of the track appears at the additional output terminals.

4. For use in apparatus for transmission of information through the rails between a railway track and a set of vehicles circulating in the same direction on that track, and along which track there are, in succession, a number of information transmission zones, resonant circuit means tuned to a carrier frequency and connected between the rails of the track at each end of an information transmission zone, said resonant circuit means comprising two identical series resonant circuits disposed in parallel and tuned to the carrier frequency, and each having capacitance connected in series with the primary winding of a transformer, the secondary windings of the two transformers being connected in series and opposition between output terminals, so that an alternating signal representative of the failure of one of the said two series resonant circuits appears at said output terminals.

5. Apparatus according to claim 4, wherein successive information transmission zones have different carrier frequencies and wherein the resonant circuits connected respectively downstream of one information transmission zone and upstream of the immediately adjacent zone are tuned to said different carrier frequencies, respectively, and have their secondary windings connected in series between said output terminals through the intermediary of the secondary winding of a further transformer having a primary winding to which means is connected for applying an alternating signal such that an alternating signal representative of the failure of one of the last-mentioned resonant circuits appears at said output terminals and enables determination of said one last-mentioned circuit.

6. Apparatus according to claim 4, wherein means is provided for connecting each of the said resonant circuits to the rails of the track by its own electrical path, and the said two transformers are provided with second secondary windings connected between additional output terminals in series and addition, so that a signal representative of the signals circulating in the rails of the track appears at the additional output terminals.

7. For use in apparatus for transmission of information through the rails between a railway track and a set of vehicles circulating in the same direction on that track, and along which track there are, in succession, a number of information transmission zones, resonant circuit means tuned to a carrier frequency and connected between the rails of the track at each end of each information transmission zone, the successive information transmission zones having different carrier frequencies, and the resonant circuit means connected respectively downstream of one information transmission zone and upstream of the immediately adjacent zone each comprising a series resonant circuit, said series resonant circuits being tuned to said different carrier frequencies, respectively, and each having capacitance connected in series with the primary winding of a transformer, the secondary windings of the two transformers being connected in series between output terminals through the intermediary of the secondary winding of a further transformer having a primary winding to which is applied an alternating signal such that an alternating signal representative of the failure of one of said resonant circuits appears at said output terminals and enables determination of said one circuit.

* * * * *